US005901388A

United States Patent [19]

Cowan

[11] Patent Number: 5,901,388

[45] Date of Patent: May 11, 1999

[54] MONO-PULL DRAWSHEET

[76] Inventor: William Thomas Cowan, 5455 La Sierra Dr., Apt. 512, Dallas, Tex. 75231

[21] Appl. No.: 09/088,806

[22] Filed: Jun. 2, 1998

Related U.S. Application Data

[60] Provisional application No. 60/079,365, Mar. 26, 1998.

[51] Int. Cl.[6] ..... A61G 7/10

[52] U.S. Cl. ..... 5/81.1 HS; 5/88.1

[58] Field of Search ..... 5/81.1 R, 81.1 HS, 5/81.1 T, 88.1, 926

[56] References Cited

U.S. PATENT DOCUMENTS

| | | | |
|---|---|---|---|
| 659,755 | 10/1900 | Moulton | 5/88.1 |
| 1,085,879 | 2/1914 | Skeffington | 5/88.1 |
| 2,827,642 | 3/1958 | Huff | 5/88.1 |
| 3,108,290 | 10/1963 | Partridge | 5/88.1 |
| 3,829,914 | 8/1974 | Treat | 5/81.1 T |
| 5,608,929 | 3/1997 | Crane | 5/81.1 HS |

*Primary Examiner*—Michael F. Trettel
*Attorney, Agent, or Firm*—John F. Bryan

[57] ABSTRACT

An apparatus which enables one person to move a patient lying in a bed up towards the head of the bed comprised of a horizontal beam placed behind the head board with a winch affixed thereto with cables running through pulleys positioned on the beam transversely to a drawsheet on the surface of the bed. The drawsheet is made with reinforced corners with locking/unlocking clips affixed thereto for attachment to the cables and has a bottom panel made of satin or other slippery fabric material to reduce friction when the patient lying thereon is drawn up towards the head board of the bed by one person turning the crank of the winch. The drawsheet is then unlocked from the cable and removed after the patient has been repositioned as desired.

13 Claims, 5 Drawing Sheets

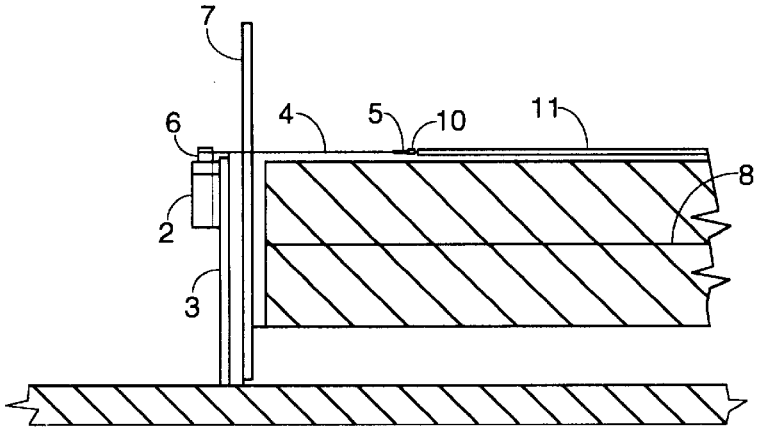
FIG. 2
FIG. 3
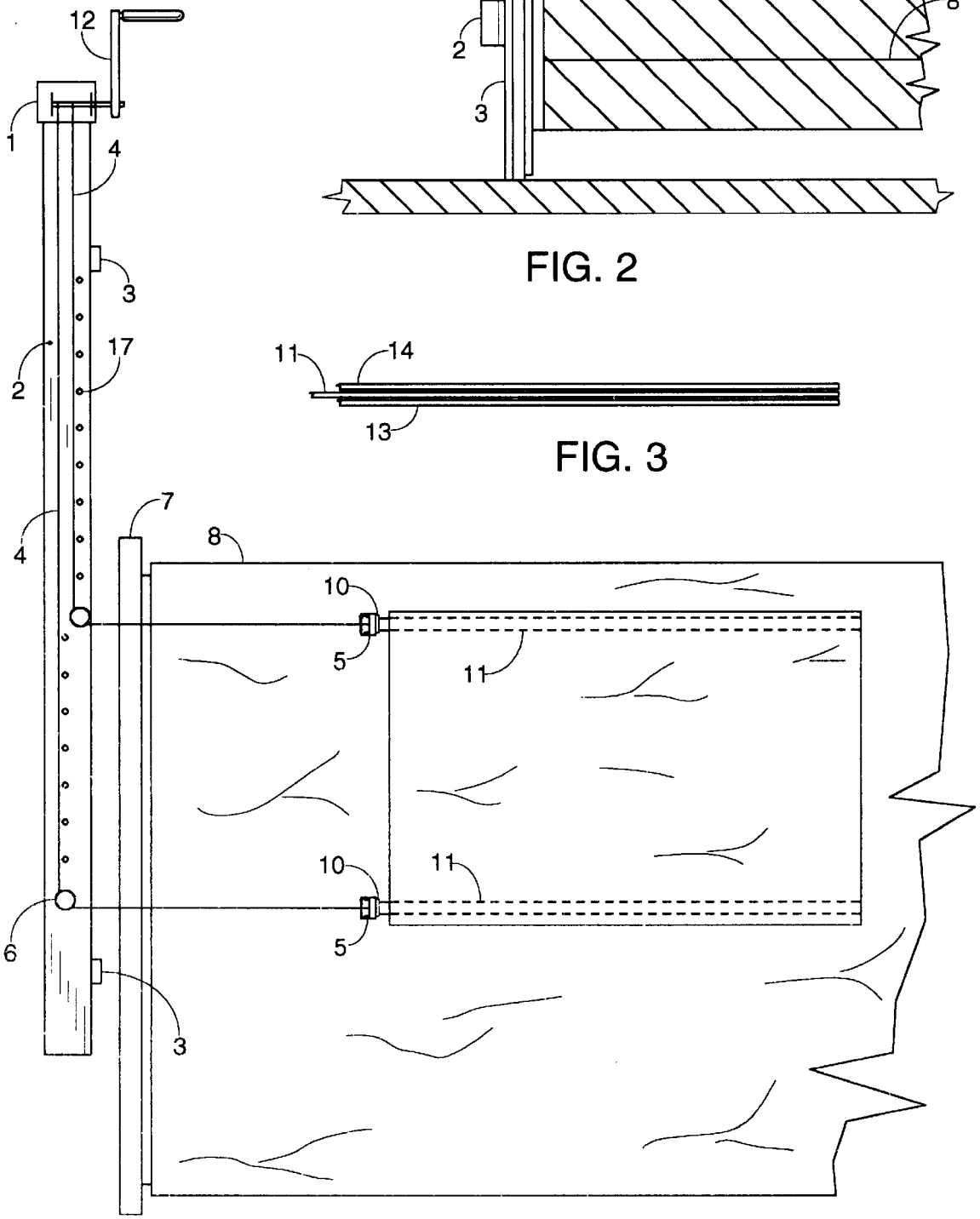
FIG. 1

MONO-PULL DRAWSHEET

CROSS-REFERENCE TO RELATED APPLICATIONS

This Application claims the benefit of U.S. Provisional Application No. 60/079365, filed Mar. 26, 1998, now abandoned.

STATEMENT REGARDING FEDERALLY SPONSORED RESEARCH OR DEVELOPMENT

Not Applicable

FIELD OF THE INVENTION

This invention relates to a system enabling one person to reposition a bedridden patient towards the head of the bed after said patient has drifted down in the bed due to necessary shifting and other normal movements.

BACKGROUND OF THE INVENTION

It is statistically known that two people are required to perform this repositioning function by placing a drawsheet under the patient and positioning themselves, one on each side, so as to lift and slide the patient towards the head of the bed. When the patient is in a double bed rather than a hospital or single bed this requires additional brute strength and discomfort to both the caregiver and the patient.

It therefore becomes a principal object of the present invention to reduce the number of people to perform this procedure from two persons to one person.

Another object of this invention is to utilize a geared down winch, either electrical or manual, so geared to reduce the effort required to slide the patient positioned on the drawsheet towards the head of the bed.

Another object of this invention is to utilize a drawsheet constructed with a low friction fabric such as satin for a bottom panel to contact the bed sheet and slide easily thereon.

Another object of this invention is to minimize discomfort to the patient by the gentle movement of the drawsheet.

SUMMARY OF THE INVENTION

It has long been known that two attendants are required in nursing homes and hospitals to perform the drawsheet movement with the patient thereon from the center or low down in the bed to the head of the bed. In private homes the single caregiver is unable to perform this function alone. In all cases the attendant or caregiver must wait until an assistant is available.

This invention will enable one person to move the patient gently and painlessly saving much time and physical effort.

The manner in which the above function is accomplished is abstractly described as a portable wooden beam, however a simple variation can be made of hollow plastic or metal tubing, placed in a horizontal position behind the headboard of the bed or between the wall and the mattress if the bed has no headboard. At one end of the beam is a winch affixed with two cables attached, each running along the beam and each threaded through a pulley affixed to the top of the beam. The pulleys are separated by a distance equal to the width of the drawsheet so that each cable will terminate at a corner of the drawsheet to be attached thereto by interlocking clasps. Rotation of the winch spool will move the drawsheet with the patient thereon towards the head of the bed.

The above procedure will be readily understood on reference to the following specifications when read in conjunction with the following drawings, wherein:

BRIEF DESCRIPTIONS OF THE SEVERAL VIEWS OF THE DRAWING

FIG. 1 is a perspective view of a conventional bed and a beam with attached winch placed behind the headboard of the bed showing two cables running from the winch through two pulleys positioned on the beam transversely to a drawsheet lying on the bed. As shown, the beam with the affixed hand cranked winch is positioned so as to provide space for a bedside table. The beam means may be repositioned to reduce the extended distance from the edge of the bed if no bedside table is present by repositioning the pulleys on the beam to be in alignment with the drawsheet by selection of two of the plurality of holes in the beam to be in such alignment.

FIG. 2 is a fragmentary side view of beam, headboard and mattress showing the top of beam being level with top of the mattress.

FIG. 3 is a representative view of the drawsheet showing construction method consisting of belting sandwiched between the top panel and bottom panel.

DETAILED DESCRIPTION OF THE INVENTION

Referring more specifically to the drawings, in FIG. 1 numeral 8 designates a conventional bed having thereon a set of box springs and mattress, the internal construction of the mattress and basic construction of the springs being well known and hence not described in detail herein. Also numerals 1 and 6 designates a winch and pulleys, each being constructed in a conventional manner and well known and hence not described in detail herein.

Figure 4:
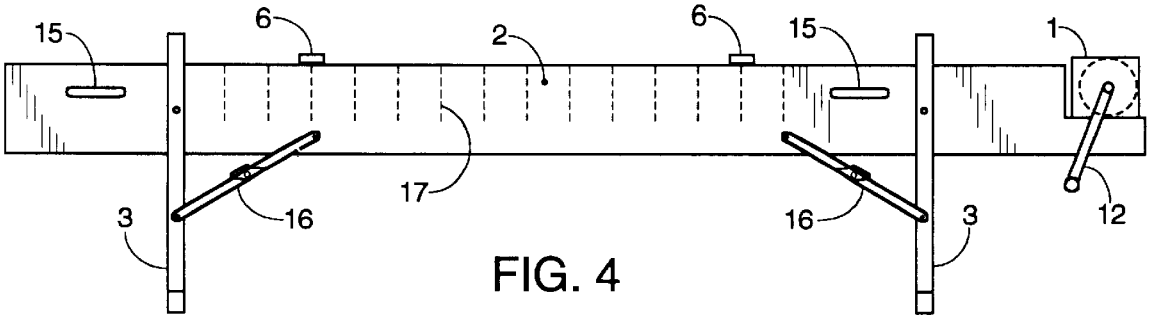
FIG. 4 is a detail view of the beam assembly showing folding legs for portability and broken lines representing a plurality of holes in the beam for optional positioning of pulleys to be in alignment with the drawsheet when beam is desired to protrude only a short distance from the side of the bed.
Figure 5:
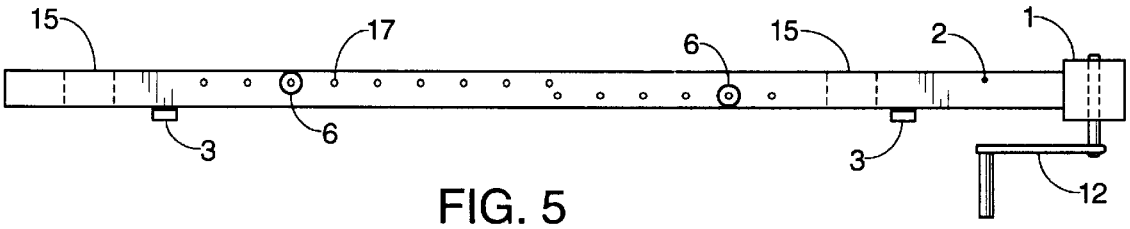
FIG. 5 is a top view of the beam showing placement of pulleys.
Figure 6:
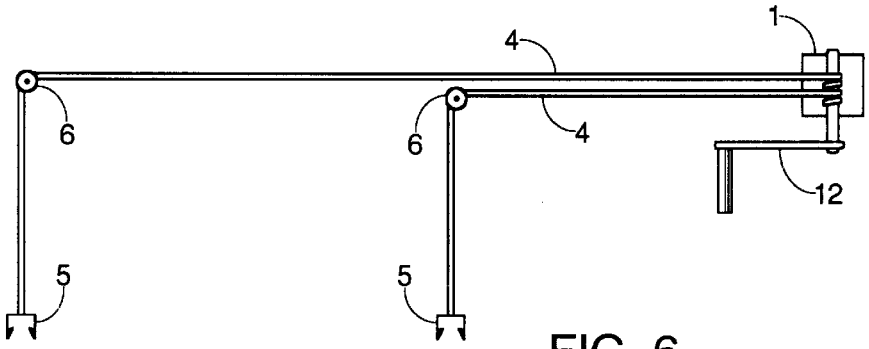
FIG. 6 is a diagram of the cable layout.
Figure 7:
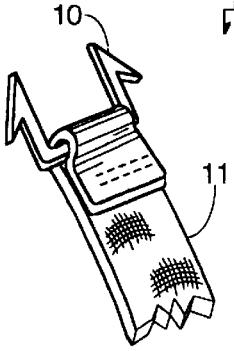
FIG. 7 is fragmentary view of the belting sewn to the male locking clasp.
Figure 8:
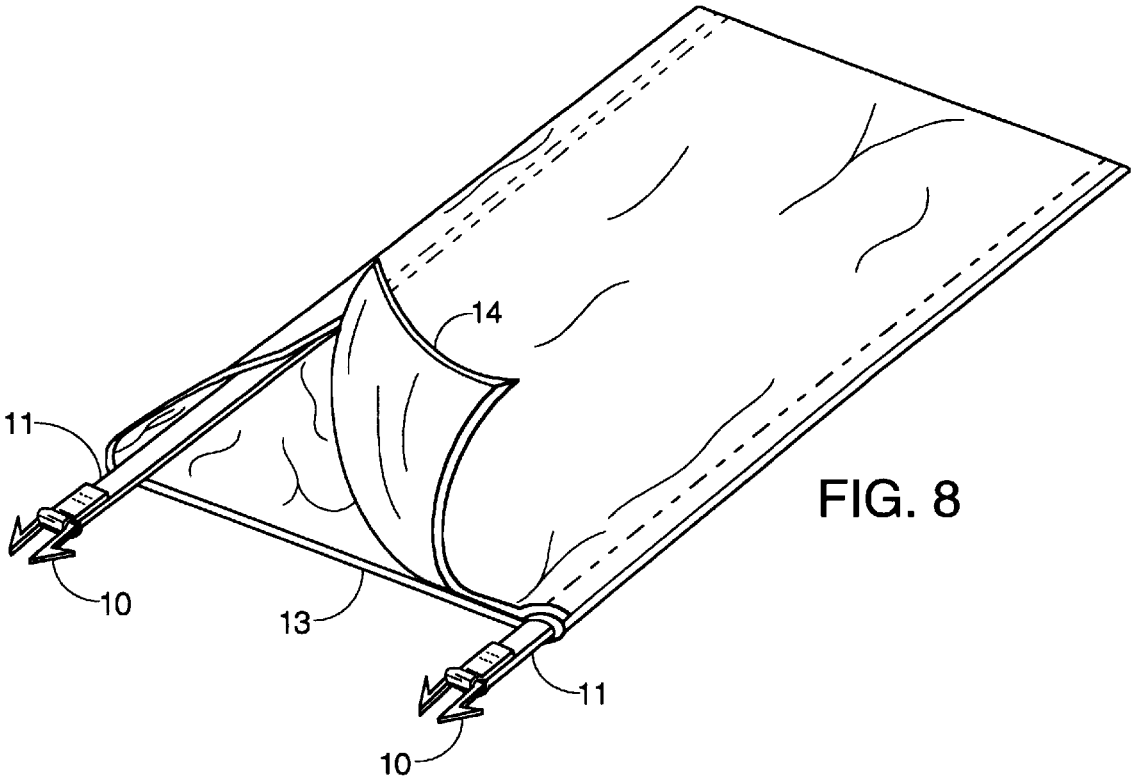
FIG. 8 is an enlarged fragmentary perspective view of the drawsheet showing its overall construction.
Figure 9:
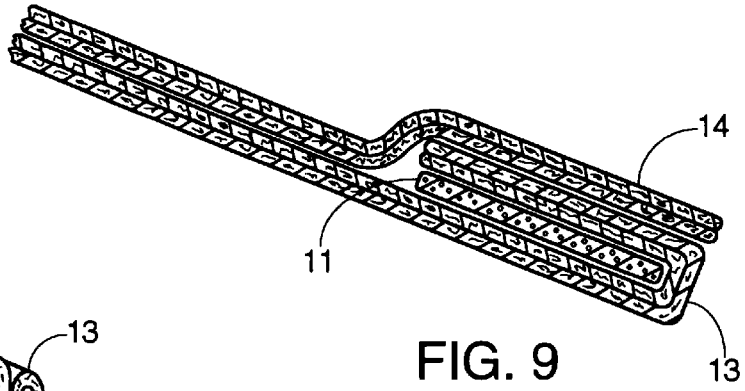
FIG. 9 is a fragmentary view of the belting sewn between the top double ply broadcloth and the bottom double ply fabric material such as satin.
Figure 10:
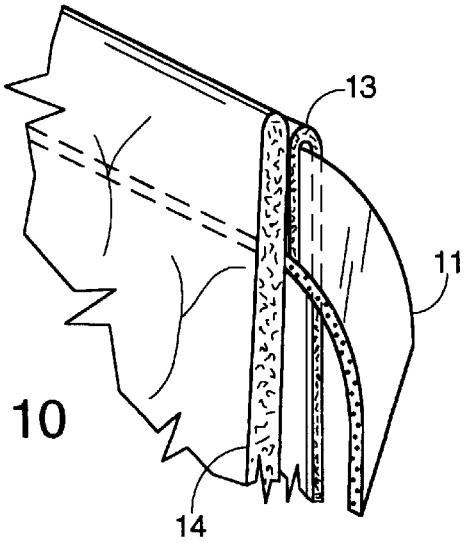
FIG. 10 is a fragmentary view of the belting protruding from the drawsheet.
Figure 11:
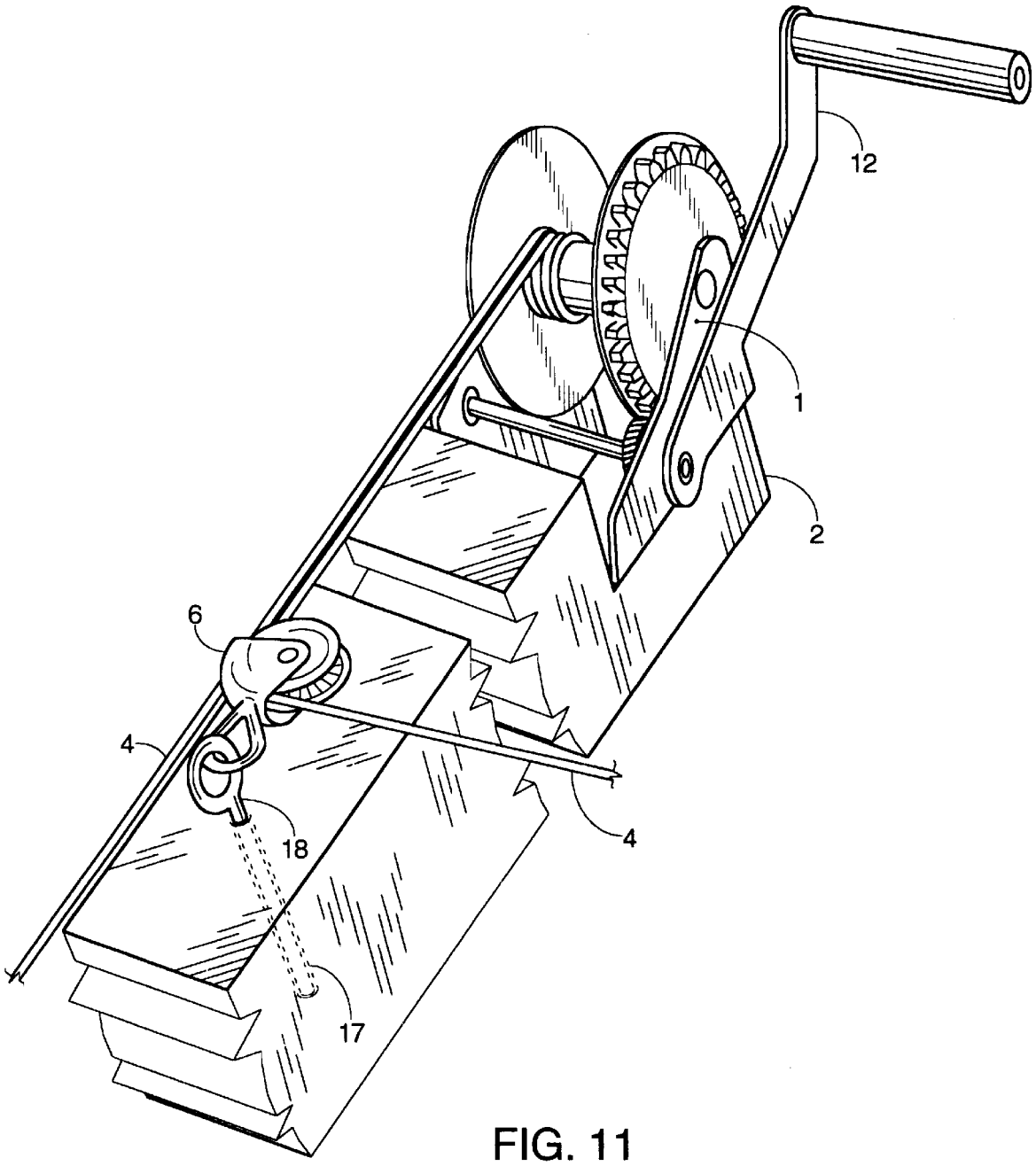
FIG. 11 is a perspective view of the winch and one representative pulley as positioned on the wooden beam.
Figure 12:
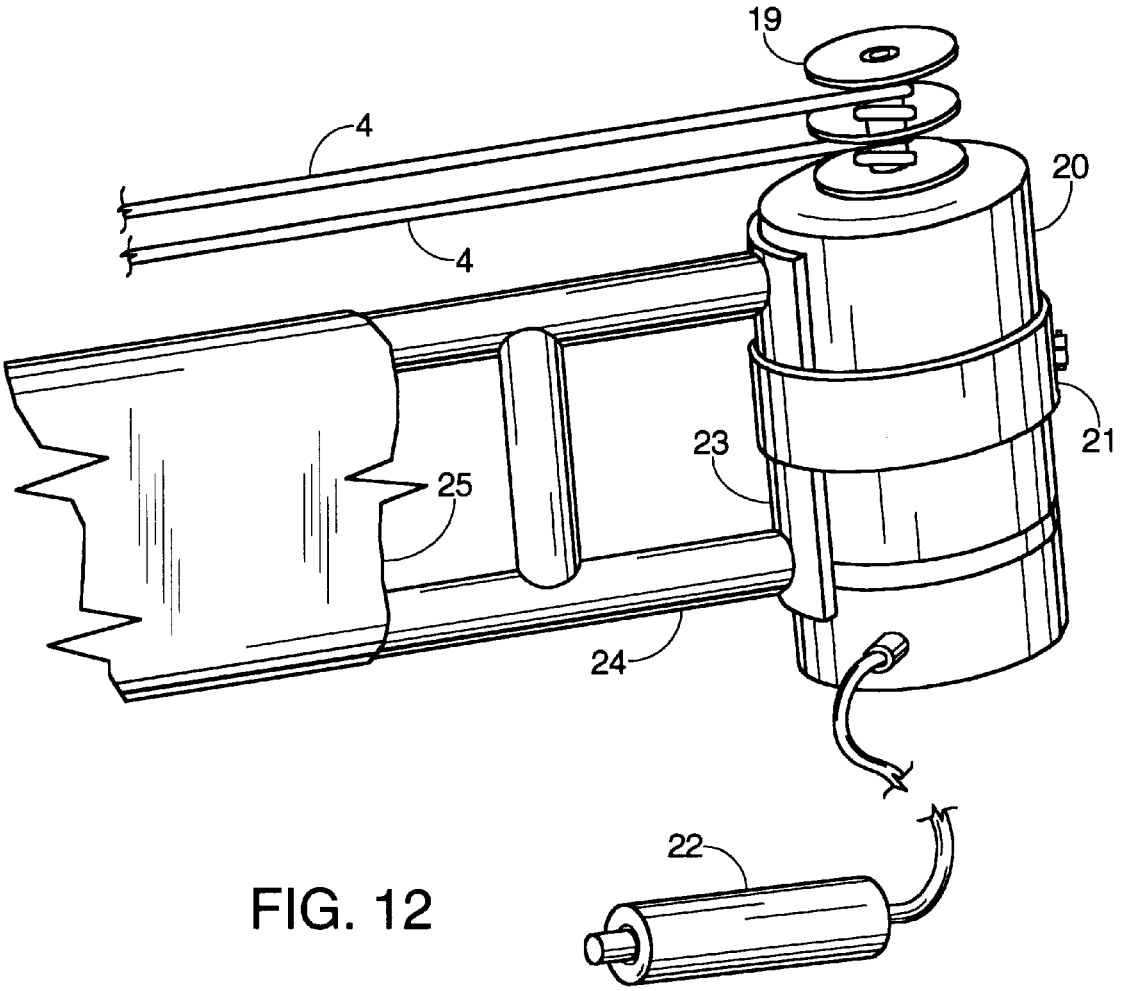
FIG. 12 is a perspective view of a simple variation in the scope of the invention employing metal tubing, sheathing and electric motor driven mechanism.
Figure 13:
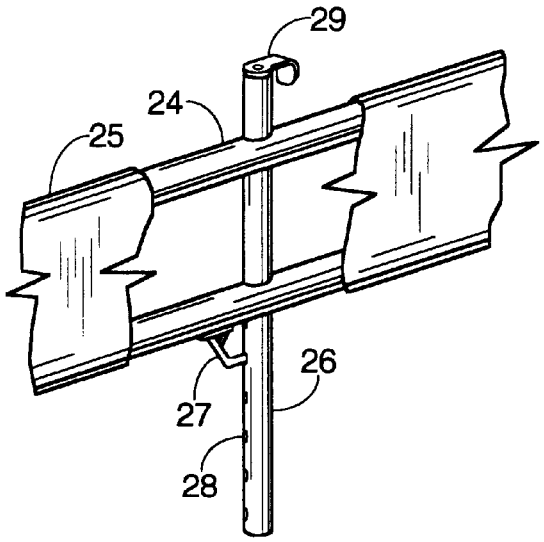
FIG. 13 is a perspective view of the adjustable leg used with the tubing type beam.

A view embodying the present invention is shown in FIG. 1 consisting of beam 2 and pair of pulleys 6. Referring to FIG. 4, a plurality of broken lines 17 represent holes drilled to a depth of 3 inches in beam 2 as receptacles for the pulley posts 18 in beam 2 and denote the various positions at which the pulleys 6 may be moved by extraction from one pair of holes 17 and insertion into another pair of holes 17 for the desired location to be in alignment with drawsheet 9. Referring to FIGS. 1 and 2, drawsheet 9 is viewed lying on bed 8. When crank 12 is turned, winch 1 winds up cables 4 which have been threaded through pulleys 6. This action causes drawsheet 9 which has been inserted beneath bedridden patient and attached to cables 4 by engaging the male and female clasps 5 and 10 to be drawn toward the head of bed 8. A drawsheet embodying the present invention is shown in FIGS. 3, 8, and 9, consisting of a rectangular piece of cloth material having a top panel 14 of double layered broadcloth and a bottom panel 13 of double layered low friction fabric such as satin. Belting material 11 is sewn between the two longitudinal sides of panels 14 and 13 extending outward from one end of the drawsheet with male clasp 10 attached as shown in FIGS. 7 and 8. All four sides of drawsheet 9 are sewn together by double stitching to ensure durability. As shown in FIGS. 4 and 5, legs 3 may be collapsed by compressing braces 16 for portability. Also depicted are slots 15 if needed for hanging beam 2 from a headboard if bed 8 is a hospital bed and high from the floor. Referring to FIG. 4, pulleys 6 may be repositioned by extracting pulley post 18 from one set of holes 17 depicted by broken lines to alternate holes as desired. FIG. 6 is a diagram of the cable 4 system showing female locking clasps 5 attached. FIG. 7 is a fragmentary view of a male locking clasp 10 attached to belting 11. Interlocking clasps 5 and 10 facilitates addition and removal of drawsheet 9 from beneath the patient. FIG. 10 is a fragmentary view of belting 11 extruding from panels 13 and 14 showing the wrap around of bottom panel 13 to belting 11. All fabric materials are washable and unshrinkable. The belting 11 is made from a woven nylon or similar flexible material. The cables 4 are made from a braided nylon or similar cordage. FIG. 11 is a fragmentary perspective view of beam 2 with winch 1 affixed thereto and pulley 6 affixed via pulley post 18 inserted in one of a plurality of insert holes 17 guiding one of two cables 4 transversely 90° as required to reach drawsheet 9. FIG. 12 is a fragmentary perspective view of an alternate beam 24 sheathed in brushed aluminum or stainless steel 25 showing mounting bracket 23 with restraining strap 21 securing electric motor 20 and dual ratchet spindles 19 with cables 4 engaged. Hand held electric switch 22 is torque controlled for safely stopping drawing action when drawsheet has reached its limited travel. FIG. 13 is a fragmentary perspective view of leg 26 for alternate beam 24 showing spring clip 27 to insert pin in one of a plurality of holes 28 for desired elevation.

Hook 25 is attached to top of leg 26 for hanging alternate beam means 24 from a high bed frame which hospitals utilize. Alternate leg 26 as shown in FIG. 13 may also be used in wooden beam 2 by drilling holes therein to accommodate such leg 26 in lieu of leg 16 in FIG. 4.

I claim:

1. Apparatus for repositioning a bedridden person comprising;

a. a bed having a first end, a second end and a top surface longitudinally disposed therebetween;

a. a substantially rectangular drawsheet with reinforced corners, said drawsheet being placed on said top surface;

b. a portable beam having first and second ends and a longitudinal axis, the beam being restrained to stay in a transversely horizontal location with respect to said bed at said first end and proximate said top surface, said beam including first and second pulleys, spaced apart at selected locations along the length of said beam;

c. a winch selectively affixed adjacent to one of the first and second ends of said beam;

d. first and second cables operatively connected to said winch, said first cable passing over said first pulley and said second cable passing over said second pulley, so as to first be pulled longitudinally with respect to said beam and then longitudinally with respect to said bed in substantial alignment with said corners; and e. connectors attaching said first and second cables to said drawsheet reinforced corners.

2. Apparatus according to claim 1 wherein said substantially rectangular drawsheet further comprises:

a flat panel having a first end including right and left hand first said reinforced corners and a second end including right and left hand second corners, said panel being of length and width adequate to support a patient's torso on said top surface, said panel first end being positioned substantially parallel to and nearest to said bed first end.

3. Apparatus according to claim 1, wherein winch includes a hand crank for manual operation.

4. Apparatus according to claim 1, wherein winch includes an electric motor for powered operation.

5. Apparatus according to claim 2 wherein said flat panel further comprises:

a top panel having at least one ply of relatively strong fabric;

a right hand longitudinal reinforcing strip sewn to said at least one ply of fabric and connecting said first and second right hand corners;

a left hand longitudinal reinforcing strip sewn to said at least one ply of fabric and connecting said first and second left hand corners; and a bottom panel having at least one ply of relatively smooth fabric and sewn to said top panel so that said smooth fabric contacts said bed top surface.

6. Apparatus for repositioning a bedridden person comprising;

a. a bed having a first end, a second end and a top surface longitudinally disposed therebetween;

a. a substantially rectangular drawsheet upon which a bedridden person may be disposed, said drawsheet being placed on said top surface;

b. a portable beam having first and second ends and a longitudinal axis, the beam being positioned in a transversely horizontal location at said first end, proximate said top surface and restrained from movment with respect thereto, said beam including first and second pulleys spaced apart along the length thereof;

c. a winch affixed adjacent said beam first end;

d. first and second cables operatively connected to said winch, said first cable passing over said first pulley and said second cable passing over said second pulley, so as to be pulled longitudinally with respect to said bed; and e. connectors attaching said first and second cables to said drawsheet.

7. Apparatus according to claim 6 wherein said substantially rectangular drawsheet further comprises:

a flat panel of a length and width adequate to support a patient's torso on said top surface, said panel having a first end including right and left hand first corners and a second end including right and left hand second corners, said panel first end being positioned substantially parallel to and nearest to said bed first end; and said connectors attaching to said first corners.

8. Apparatus according to claim 6, wherein said winch includes a hand crank for manual operation.

9. Apparatus according to claim 6, wherein said winch includes an electric motor for powered operation.

10. Apparatus according to claim 6 and further comprising means for alternatively affixing said winch at said beam second end.

11. Apparatus according to claim 6, wherein said drawsheet has at least two reinforced corners to which said connectors are attached.

12. Apparatus according to claim 6, wherein alternative locations are provided for selectively positioning said first and second pulleys to align with said drawsheet corners.

13. Apparatus according to claim 7 wherein said flat panel further comprises:

a top panel having at least one ply of relatively strong fabric;

a right hand longitudinal reinforcing strip sewn to said at least one ply of fabric and connecting said right hand first and second corners;

a left hand longitudinal reinforcing strip sewn to said at least one ply of fabric and connecting said left hand first and second corners; and a bottom panel having at least one ply of relatively smooth fabric and sewn to said top panel so that said smooth fabric contacts said bed top surface.

* * * * *